United States Patent [19]

Matsusaka

[11] 4,021,144

[45] May 3, 1977

[54] SUBMERSIBLE PUMP WITH FLOAT SWITCH

[75] Inventor: Tanechiyo Matsusaka, Kishiwada, Japan

[73] Assignee: Elepon Kabushiki Kaisha, Osaka, Japan

[22] Filed: Sept. 17, 1975

[21] Appl. No.: 614,154

[52] U.S. Cl. ..... 417/40; 200/81.9 M

[51] Int. Cl.[2] ..... F04B 49/00; H01H 35/40

[58] Field of Search ..... 417/40; 200/81.9 M, 200/84 C; 73/308

[56] References Cited

UNITED STATES PATENTS

| | | | |
|---|---|---|---|
| 2,927,174 | 3/1960 | Walshin | 417/40 |
| 3,113,189 | 12/1963 | Porwancher | 200/81.9 M |
| 3,114,478 | 12/1963 | Hilkemeier et al. | 73/308 |
| 3,285,183 | 11/1966 | Hembree | 200/83.9 M |
| 3,291,934 | 12/1966 | Nealy | 73/308 |
| 3,325,612 | 6/1967 | Petersen et al. | 200/81.9 M |
| 3,327,079 | 6/1967 | Widl | 200/81.9 M |
| 3,659,064 | 4/1972 | Inoue | 200/84 C |
| 3,874,223 | 4/1975 | Miyazaki et al. | 73/308 |

*Primary Examiner*—William L. Freeh
*Attorney, Agent, or Firm*—Wenderoth, Lind & Ponack

[57] ABSTRACT

The combination of a submersible electric pump, a holder on the pump, a cable holder movably mounted in the holder, a float having a switch therein which is actuated depending on the position of the float in a body of liquid, and a cable extending from the pump to the float and electrically connecting the switch to the pump for controlling the running of the pump depending on the condition of actuation of the switch. A point intermediate the length of the cable is held in the cable holder, whereby the level of the liquid in which the float is positioned at which the pump will be started and stopped can be controlled by adjusting the position of the cable holder in the holder and the point along the length of the cable which is supported on the cable holder.

1 Claim, 3 Drawing Figures

SUBMERSIBLE PUMP WITH FLOAT SWITCH

The present invention relates to a submersible pump and more particularly to a submersible pump combined with a float switch which is especially useful for controlling the level of a body of liquid.

Heretofore, a liquid level control system has required a submersible pump and a separate controller therefor which is installed separately. This not only is somewhat expensive to make, but is somewhat troublesome to install.

It is an object of the present invention to provide a combination of a submersible pump and a float switch therefor which can be manufactured and installed as a single unit.

This object is achieved by the combination, according to the invention, of a submersible electric pump, a holder on said pump, a cable holder movably mounted in said holder, a float havng a switch therein which is actuated depending on the position of the float in a body of liquid, and a cable extending from said pump to said float and electrically connecting said switch to said pump for controlling the running of said pump depending on the condition of actuation of said switch, a point intermediate the length of said cable being held in said cable holder, whereby the level of the liquid in which said float is positioned at which said pump will be started and stopped can be controlled by adjusting the position of said cable holder and the point along the length of said cable which is supported on the cable holder.

The invention will now be described with reference to the accompanying drawings, in which.

Figure 1:
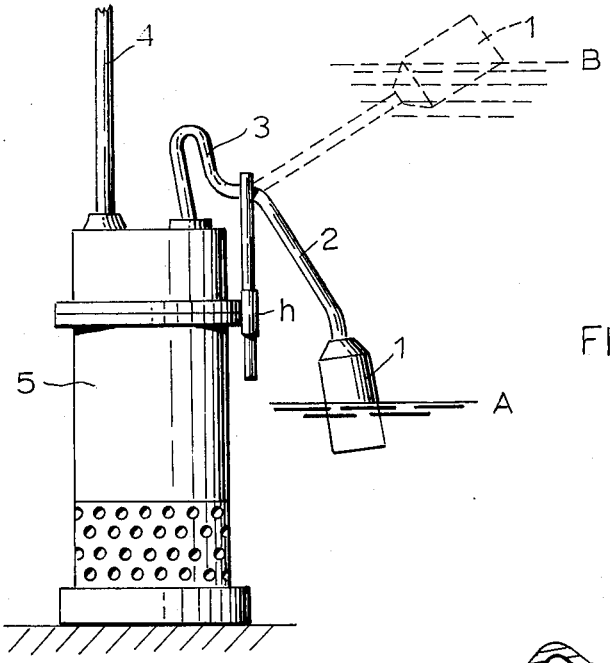
FIG. 1 is an elevational view showing the submersible pump with a float switch according to the invention.

As shown in FIG. 1, the submersible pump with the float switch according to the invention is comprised of a float 1 haviang a switch therewithin, the switch being electrically coupled to the electric power circuit of an electrically driven submersible pump 5 by a covered cable 2 connected between the float and the pump. The main power supply to the pump 5 is by a further covered cable (not shown), and the liquid picked up by and pumped by the pump is discharged through the pipe 4 extending upwardly from the pump 5. A point on said covered cable 2 intermediate the ends is adjustably mounted in a cable holder 3, said cable holder also being adjustably mounted on a holder h on the pump 5. Consequently, the point along the length of the covered cable 2 at which it is supported can be varied, and the cable holder 3 can also be moved up and down within the holder h.

Figure 2:
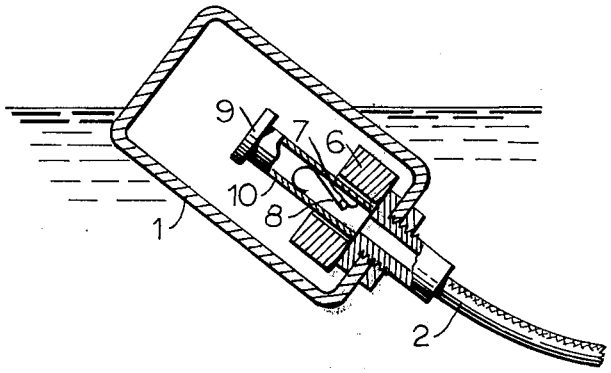
FIG. 2 is a sectional view, on an enlarged scale, of one embodiment of a float switch usable with the arrangement of FIG. 1.
Figure 3:
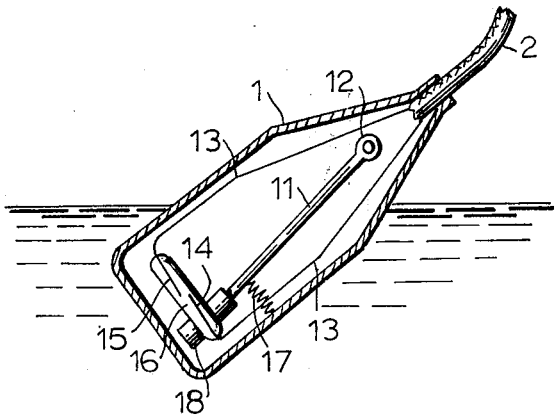
FIG. 3 is a sectional view similar to FIG. 2 of another embodiment of a float switch.

As shown in FIGS. 2 and 3, the float has a switch therewithin which is closed and opened as the float is raised and lowered. The embodiment of FIG. 2 comprises a sleeve 10 mounted on the fitting at the one end of the float and having a flange 9 on the free end thereof. Ferromagnetic switch elements 7 and 8 are positioned within the sleeve 10, one of which is movable toward and away from the other to make and break contact. The switch elements 7 and 8 are normally spaced apart so that they interrupt the circuit therethrough. Slidable along the sleeve 10 is an annular permanent magnet 6, which when it is at the end corresponding to the switch elements 7 and 8 moves the movable switch element into contact with the other element. The switch accordingly opens and closes in response to the movement of the magnet 6 back and forth along the sleeve 10. The movement of the magnet 6, on the other hand, is responsive to the inclination of the sleeve 10, which in turn is governed by the position of the float 1. This embodiment of the float is designed to be used when the float is to be used when the float is to be floating on its side with the sleeve 10 more or less horizontal. When the level of the liquid rises, the end of the float attached to the cable 2 will be held while the free end rises, thereby tilting the sleeve 10 to cause the magnet 6 to slide along the sleeve to a position adjacent the contacts 7 and 8 and close the contacts. This actuates the control circuit in the motor of the pump 5 to run the pump, for example by closing a solenoid switch, to thereby pump liquid out of the body of liquid in which the pump is submerged, thereby lowering the float. When the float is lowered sufficiently to cause the magnet 6 to slide to the other end of the sleeve 10 against the flange 9, the contacts 7 and 8 are opened and the pump stops pumping.

The embodiment of FIG. 3 is designed to be used when the float is to be floating in a substantially upright position. The switch has a sleeve 16 with contacts 14 and 15 therein which are designed to be closed when an annular magnet 18 moves thereover. The contacts 14 and 15 are connected to the cable 2 by leads 13. The annular magnet 18 is mounted on a pendulum arm 11 pivoted at 12 at the end of the float adjacent the connection for the cable 2. A spring 17 urges the pendulum arm 11 in one direction of rotation, clockwise in the configuration shown in FIG. 3. When the float 1 is nearly in the upright position, the spring 17 urges the pendulum arm 11 to a position such that the magnet 18 is aligned with the contacts 14 and 15. With the contacts closed, the control circuit of the pump 5 is kept inactive, for example by a solenoid which is held open when energized. When the level of the liquid increases, however, the float tends to swing upwardly around the point of the cable 2 held in holder *h*, and the pendulum arm 11 is swung, when the inclination of the float is in the direction as shown in the drawing, counterclockwise due to the weight of the magnet 18 on the end thereof, thus moving the magnet 18 away from the contacts 14 and 15 and allowing them to open. This changes the control circuit in the pump 5, for example by deenergizing a control solenoid, causing it to run pump liquid from the body of liquid in which it is submerged. When the level of the liquid falls sufficiently, the float 1 again nears a vertical position and the spring 17 urges the pendulum arm 11 clockwise until the magnet 18 is again around the contacts 14 and 15, thus closing the control circuit and stopping the running of the pump.

It will be seen that the float with the switches as shown in combination with the pump can act as a means for keeping the level of liquid in the body of water substantially constant.

It will be understood that the specific switch structures are only exemplary. Mercury switches could, for example, be used in place of the switches described. Moreover, the movement of the magnet could cause the reverse action of the contacts, and a reverse actuation of relay means in the motor control circuit for the pump 5.

The above described pump and float system has the advantages of:

a. The installation of the system is simply by placing the pump in the body of liquid with the float attached thereto, rather than separate installation of a pump and a water level control. The cost of installation is therefore kept to a minimum by the system of the present invention.

b. The level of the liquid at which the pump starts and stops can be easily and quickly set by a simple adjustment of the length of the electric cable 2 between the float and the cable holder 3.

c. Further adjustment of the level at which the float switch will operate to start and stop the pump can be easily carried out by adjustment of the cable holder 3 up and down in the holder *h*.

What is claimed is:

1. An apparatus to be positioned in a body of liquid for pumping said liquid, said apparatus comprising in combination:

a submersible electric pump in said body of liquid;

floating switch means floating on said body of liquid for actuating said pump in response to the position of said switch means in said liquid, said switch means comprised of:

a hollow float, a pair of contacts within said float, at least one of said contacts being movable toward and contactable with the other contact, magnetic means pivotably mounted within said float for attracting said contacts together and causing said contacts to contact each other, and biasing means connected to said magnetic means for biasing said magnetic means into a position adjacent said contacts and causing said contacts to contact each other when said float is vertically positioned in said body of liquid, said biasing force being overcome by the weight of said magnetic means when said float is tilted away from the vertical a predetermined amount, whereby tilting said float caused by the rise in the liquid level of said body of liquid causes said magnetic means to pivotally rotate against said biasing means away from said contacts, thereby allowing said contacts to move apart;

a cable electrically connecting said pump to said contacts of said switch means; and adjustible cable holder means fixed to said pump and having said cable held therein at an intermediate position of said cable for adjusting the position of said cable connecting said pump and said swtich means, said adjustable cable holder means comprised of:

a holder attached to said pump, and a cable holder adjustably fitted in said holder and holding said cable at an intermediate portion thereof, whereby adjusting the position of said cable holder controls the position of said cable and thus the level of said liquid body at which point said float will tilt sufficiently to cause said switch means to activate said pump.

* * * * *